United States Patent [19]

Carlsson

[11] 4,145,039

[45] Mar. 20, 1979

[54] METHOD AND APPARATUS FOR CONVEYING SHEETS OF CORRUGATED CARDBOARD OR SIMILAR MATERIAL THROUGH A PROCESSING MACHINE

[75] Inventor: Stig M. Carlsson, Örebro, Sweden

[73] Assignee: Sunds AB, Sweden

[21] Appl. No.: 833,552

[22] Filed: Sep. 15, 1977

[30] Foreign Application Priority Data

Sep. 15, 1976 [SE] Sweden ..... 7610222

[51] Int. Cl.[2] ..... B65H 5/02

[52] U.S. Cl. ..... 271/274; 226/172

[58] Field of Search ..... 271/272, 273, 274; 100/151, 152, 153, 154; 226/172

[56] References Cited

U.S. PATENT DOCUMENTS

| | | | |
|---|---|---|---|
| 917,503 | 4/1909 | Swift | 100/154 X |
| 1,764,456 | 6/1930 | Mantius | 100/152 X |
| 2,833,211 | 5/1958 | Trier | 101/177 |
| 3,266,690 | 8/1966 | Goettsch | 226/172 X |
| 3,266,799 | 8/1966 | Ingalls | 226/172 X |
| 3,676,268 | 7/1972 | Brandenburg | 100/154 X |

FOREIGN PATENT DOCUMENTS

| | | | |
|---|---|---|---|
| 1024096 | 2/1958 | Fed. Rep. of Germany. | |
| 1222523 | 12/1958 | France | 271/272 |
| 189422 | 2/1937 | Switzerland. | |
| 740671 | 11/1955 | United Kingdom | 100/151 |

*Primary Examiner*—Richard A. Schacher

*Attorney, Agent, or Firm*—Hill, Gross, Simpson, Van Santen, Steadman, Chiara & Simpson

[57] ABSTRACT

A method of conveying sheets of e.g. corrugated cardboard through a processing machine, comprising a feed-in unit and units for carrying out printing, punching, slotting etc. of the sheet, in which the sheet is gripped between a belt with a flat gripping surface and a belt with a non-planar gripping surface disposed at a distance from each other, which distance is smaller than the thickness of the sheet, so that the non-planar belt clamps the sheet securely against the flat belt while deforming the sheet. Apparatus for carrying out said method has conveyor and support means for the sheet. The conveyor means has two cooperating belts one of which is a flat toothed belt running over two deflecting rollers one of which is forcibly driven. The second conveyor belt is non-planar and disposed at a distance smaller than the thickness of the sheet from the flat belt and runs over freely journalled deflecting and supporting rollers which oppose the corresponding rollers for the flat belt.

7 Claims, 4 Drawing Figures

METHOD AND APPARATUS FOR CONVEYING SHEETS OF CORRUGATED CARDBOARD OR SIMILAR MATERIAL THROUGH A PROCESSING MACHINE

BACKGROUND

1. Field of the Invention

The present invention relates to a method of and apparatus for conveying sheets of corrugated cardboard or similar material through a processing machine for carrying out various processing operations such as printing, punching, slotting etc. of the sheet.

2. Prior Art

In certain types of machines for converting sheets of corrugated cardboard or similar material into boxes or box blanks, the sheets must be moved from a feed-in unit through one or more processing units, for example for printing, punching or similar operations. To produce satisfactory results, the sheet while being conveyed must be held in a secure grip so that it will neither slip in the direction of conveyance nor yaw.

The usual methods of conveyance up to now have used feeder rollers or rollers over the whole width of the sheet, or vacuum devices. These arrangements have many disadvantages. For example when using feeder rollers there is always the risk that the print on the sheet will be affected, and when using vacuum devices, the required fans and pumps, for machines of the size in question, will be so large that they cause, among other things, significant environmental problems at the places of work.

It is known by Swiss Patent Specification No. 189,422 to use cooperating conveyor belts to convey print sheets through printing presses. The belts are V-belts with flat surfaces facing each other and run over pulleys. When these V-belts with flat surfaces facing one another are used in conveying in printing, the risk is great that the printing will not appear exactly in the intended place on the sheet due to slipping between the belts and the pulleys as well as between the sheets and belts in the processing directions, and/or yaw of the sheet relative to the belts.

SUMMARY OF THE INVENTION

The object of the present invention is to reduce to a minimum the risk that the sheet will be processed at the wrong place.

This result is achieved according to the invention by gripping the sheet between a belt with a flat gripping surface and a belt with a non-planar gripping surface, disposed at a distance from one another which is less than the thickness of the sheet, so that the non-planar belt clamps the sheet securely against the flat belt while deforming the sheet. Through deformation the sheet is held in a secure grip, preventing slipping between the sheet and belt in the feed direction as well as yaw of the sheet.

Apparatus for carrying out the invention, comprises conveyor means and support means for the sheet, the conveyor means having two cooperating belts, one of the belts being a flat toothed belt running over two deflecting rollers of which one is forcibly driven, at least one support roller being disposed between the deflecting rollers so that the distance between two rollers is at most half of the dimension in the direction of conveyance of the smallest sheet for which the apparatus is intended, the second conveyor belt being a non-planar belt disposed at a distance less than the thickness of the sheet from the flat belt and running over freely journalled deflecting and supporting rollers, which oppose the corresponding rollers for the flat belt, and the support means comprising support bands distributed over the working width of the machine and driven at the speed of the flat belt, and whose forward deflecting rollers, in the direction of conveyance, are arranged coaxially with corresponding rollers for the flat belt. The fact that the flat belt is a toothed belt prevents any possibility of slipping between the belt and pulley, which is an additional assurance that the sheet will be processed at the intended location.

ON THE DRAWINGS

AS SHOWN ON THE DRAWINGS

Figures 1, 2, 3:
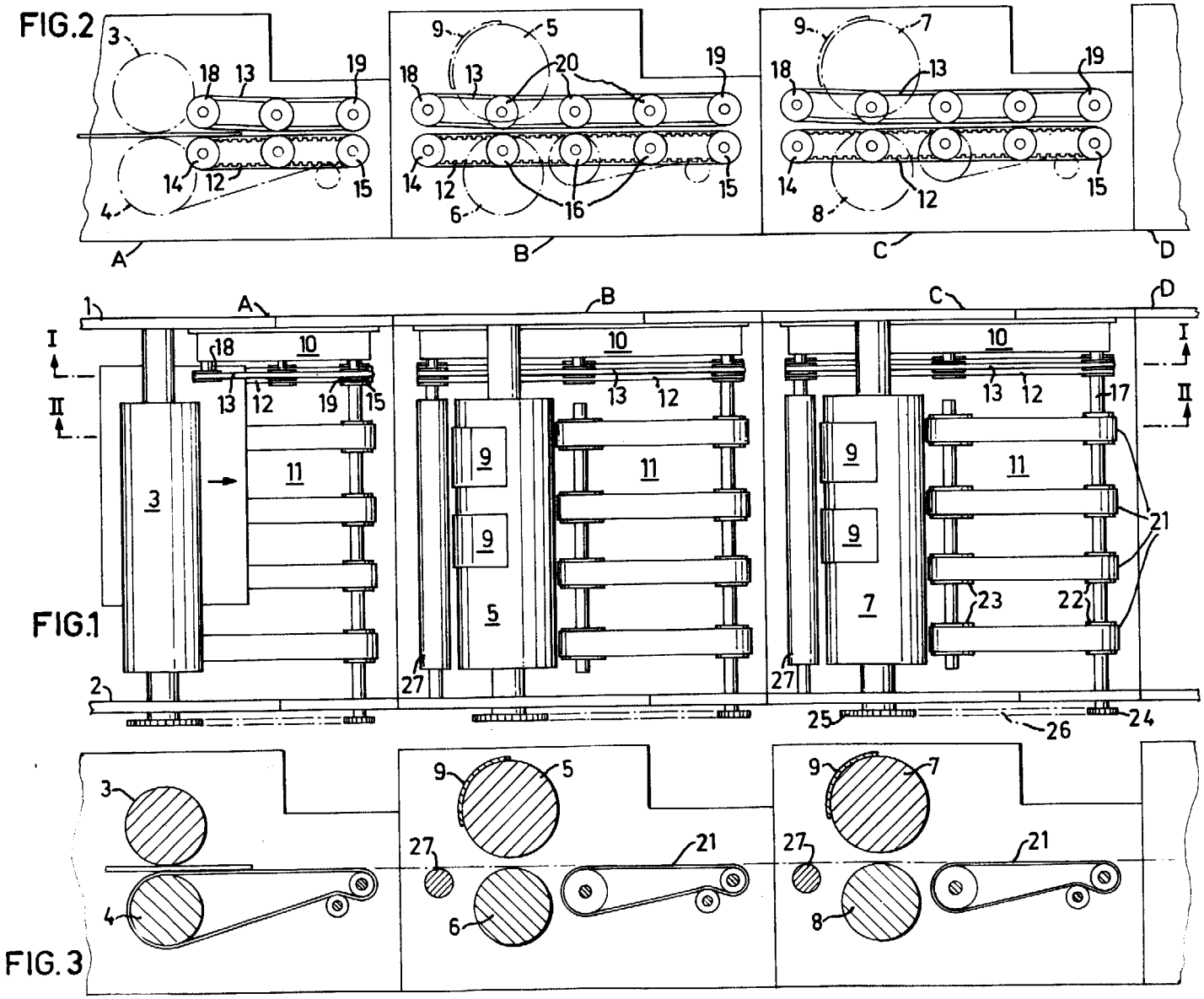
FIG. 1 is a schematic view from above of a portion of a composite machine for conversion of corrugated paper sheets into boxes, provided in accordance with the invention.
FIG. 2 is a longitudinal cross section through FIG. 1, taken along the line I—I.
FIG. 3 is a corresponding longitudinal cross section through FIG. 1 along the line II—II.
Figure 4:
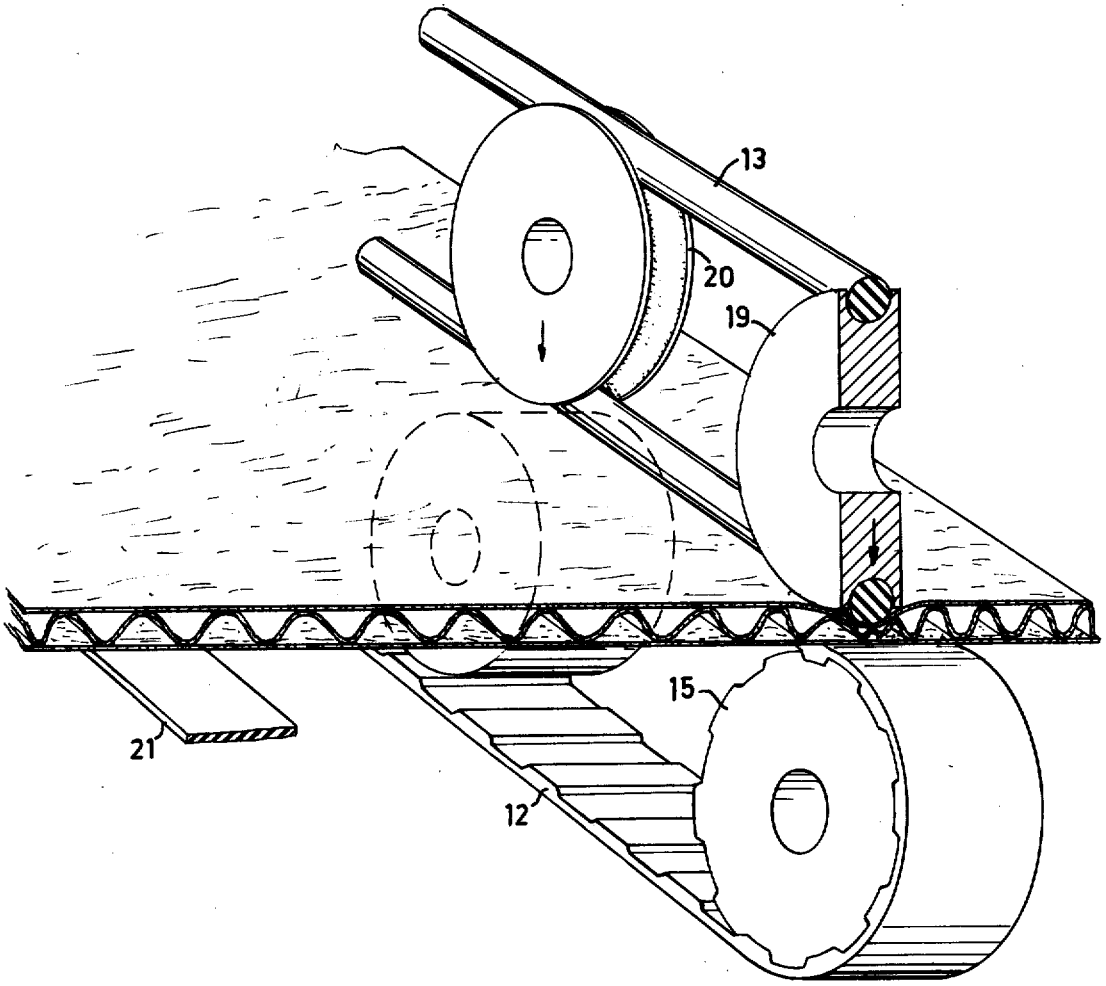
FIG. 4 is a perspective view, partially cut-away, of a portion of the conveyor device.

The apparatus disclosed includes a feed-in unit A for the sheet, only those parts of which are pertinent to the invention being shown. A pair of units B, C are for printing on the sheet, while an additional printing unit D or another type of processing unit represents additional units that can be added to those shown.

Each unit A–D has a frame with a pair of sides 1,2 (not shown otherwise. A number of sheet processing rollers 3,4,5,6,7,8 are journalled in the sides 1,2. These sheet-processing rollers can have different functions in the various units. The rollers 3,4 in the feed-in unit A function as feeder rollers and the rollers 5,6,7,8 in the printing units B, C function as printing and counter rollers, of which the rollers 5 and 7 carry a number of plates 9.

In every unit A–D there is a conveyor device 10 and a support device 11.

The conveyor device 10 is made up of a lower flat conveyor belt 12, which is preferably an endless toothed belt, and an upper non-planar conveyor belt 13, which is preferably an endless belt with circular cross section.

The lower conveyor belt 12 runs over a pair of deflecting rollers 14,15 and a number of support rollers 16, the deflecting roller 15 being connected to a driven axle 17 (FIG. 1) while the rollers 14 and 16 are free.

The upper conveyor belt 13 runs in a corresponding manner over a pair of deflecting rollers 18 and 19 and a supply of support rollers 20. All of these rollers 18,19 and 20 are free-running. The roller 19 and 20 are spring loaded (not shown) against the opposing rollers 15 and 16, while the rollers 18, via an eccentric bearing (not shown) can be adjusted to the desired distance from the opposing rollers 14.

The spacing of the rollers 14–16, 18–20 in the direction of conveyance is chosen so that the distance between the adjacent pairs of rollers is less than half of the dimension, in the direction of conveyance, of the smallest sheet for which the apparatus is intended. Thus the sheet is always held by at least three pairs of rollers.

The supporting device 11 comprises a number of endless conveyor belts 21, running between a number of driven rollers 22 and a number of free-running rollers 23. The driven rollers 22 are connected, as are the drive rollers 15 for the conveyor belt 12, by the axle 17. Each axle 17 is driven via a pair of chain wheels 24,25 and a chain 26 geared so that the conveyor belts 12 and the support belts 21 will have the same linear speed as the active periphery of the processing rollers 3-4-5-6-7-8. To assure support for the sheet at the transition between the units A-B-C-D, there are a number of support rollers 27, extending transversely across the breadth of the machine and driven by means of a connection with the deflecting rollers 14. The following advantages are achieved with the device described above: each machine unit has its own conveyor and support device for the sheet, and a pratically limitless number of units can be coupled together without requiring special devices to assure sheet conveyance though the complete machine.

What I claim is:

1. A method of conveying individual prefabricated sheets of corrugated cardboard or similar material through a processing machine, the machine comprising a feed-in unit and at least one unit with processing means, said method comprising: gripping the sheet along a marginal edge thereof between a first moving belt with a flat gripping surface and a second belt moving at the same speed with a non-planar gripping surface, said surfaces being disposed at a distance from one another which is less than the thickness of the sheet, so that the non-planar belt clamps the sheet securely against the flat belt while temporarily deforming the thickness of the sheet at its marginal edge.

2. A method according to claim 1 in which the sheet is conveyed through the processing machine by a separate set of said conveyor belts within each of a plurality of said units, the sheet being received from a preceding unit, transported through the unit, and being delivered to a subsequent unit without any release of, even momentarily, the grip on the sheet and thereby the control of the position of the sheet in the operating direction of the machine.

3. Apparatus for conveying individual prefabricated sheets of corrugated cardboard or similar material along a path through a processing machine having a feed-in unit and a processing unit, said conveyor apparatus comprising:

(a) a pair of cooperating conveyor belts arranged in opposition to each other, said belts being disposed at one side of said path for gripping a sheet along a marginal edge thereof, one of said belts having a cross-section with a flat edge directed toward said path, and the other of said belts having a cross-section with a non-planar edge directed toward said flat edge;

(b) a pair of deflecting rollers, one of which is power driven, over which said one of said belts runs;

(c) at least one support roller disposed between said deflecting rollers, the distance between any two rollers being at most one-half of the dimension in the direction of conveyance of the smallest sheet for which the apparatus is intended;

(d) a corresponding number of freely journaled deflecting and support rollers supporting said other of said belts, and respectively opposing corresponding rollers for said one belt;

(e) means on one of said units supporting all said rollers so that the space between said belts is less than the thickness of the sheet;

(f) a plurality of support belts laterally distributed over the working width of the machine; and (g) forward and rearward deflecting rollers carried by said one unit over which said support belts run, one of said last-named deflecting rollers being power driven such that said support belts move at the speed of said one conveyor belt, one of said last-named deflecting rollers which is forward in the direction of conveyance, being coaxial with the corresponding one of said deflecting rollers for said one conveyor belt.

4. Apparatus according to claim 3, including drive means for (1) said one of said deflecting rollers for said one conveyor belt, and (2) said one of said deflecting rollers for said support belts, disposed within said one of said units, said drive means imparting the same linear speed to said one conveyor belt and to said support belts as the peripheral speed of a processing roller in said one unit.

5. Apparatus according to claim 3, said support means for said first deflecting roller, as seen in the direction of conveyance, of said non-planar conveyor belt being adapted to be raised and lowered in relation to said flat conveyor belt, and the rest of said rollers of said non-planar conveyor belt being spring-loaded against said flat belt, so that raising or lowering said first deflecting roller also causes a change in the smallest distance between the rest of the rollers of said non-planar belt and said flat belt, thereby also altering said space between said conveyor belts and hence the degree of temporary deformation of the sheet at its marginal side.

6. Apparatus according to claim 3, said non-planar belt being an endless belt with circular cross-section.

7. Apparatus according to claim 3, the first and the last pair of said deflecting rollers for said conveyor belts in each unit being placed so that when a plurality of said units are arranged consecutively in a row, the distance between the last pair of deflecting rollers in a unit and the first pair of deflecting rollers in a next unit will be at most equal to one-half of the dimension in the direction of conveyance of the smallest sheet for which the apparatus is intended.

* * * * *